United States Patent [19]

Panick

[11] Patent Number: 4,742,933

[45] Date of Patent: May 10, 1988

[54] CONTAINER OF PLASTICS MATERIAL

[75] Inventor: Klaus Panick, Ahlen, Fed. Rep. of Germany

[73] Assignee: Joh. Panick GmbH & Co. KG, Ahlen, Fed. Rep. of Germany

[21] Appl. No.: 945,647

[22] Filed: Dec. 23, 1986

[30] Foreign Application Priority Data

Jan. 17, 1986 [DE] Fed. Rep. of Germany ... 8601022[U]
Feb. 15, 1986 [DE] Fed. Rep. of Germany ... 8604086[U]

[51] Int. Cl.[4] ..... B65D 21/00

[52] U.S. Cl. ..... 220/69; 220/355; 206/511; 108/56.3

[58] Field of Search ..... 220/69, 1.5, 355; 108/51.1, 53.1, 56.3; 206/208, 211, 511; 217/43 A

[56] References Cited

U.S. PATENT DOCUMENTS

| | | | |
|---|---|---|---|
| 3,316,861 | 5/1967 | Dailey | 108/56.3 |
| 3,419,184 | 12/1968 | Asenbauer | 220/355 X |
| 3,567,068 | 3/1971 | Carfizzi | 220/69 |
| 4,042,111 | 8/1977 | Smith | 206/511 X |

*Primary Examiner*—Steven M. Pollard
*Attorney, Agent, or Firm*—Toren, McGeady & Associates

[57] ABSTRACT

A container of plastics material for mortar having such a holding capacity that it can be carried by one person in the filled state either not at all or with great difficulty. The container has support bars on its bottom side and is equipped on its top or filling side with two essentially symmetrically constructed plastics material covers.

11 Claims, 4 Drawing Sheets

CONTAINER OF PLASTICS MATERIAL

BACKGROUND OF THE INVENTION

1. Field of the Invention

The present invention relates to a container of plastics material. More particularly, the invention relates to a container for mortar having such a holding capacity that it can be carried by one person in the filled state either not at all or only with great difficulty.

2. Description of the Prior Art

Containers for mortar of the above-described type are known, for example, from German Utility Model No. 81 10 324. These prior art containers of plastic material are sold, for example, in sizes ranging from 100 to 350 liters. The containers serve to hold such an amount of mortar which can usually be processed by a worker during a single work day. When these containers are filled, they can be moved by a single person either not at all or only with great difficulty and, therefore, they must be moved by means of conveying vehicles, such as, cranes or the like.

In order to make possible such manipulations of the containers by means of cranes, gripping tools or the like, it is known in the art to reinforce the upper rims of such containers. For example, the containers may have circumferentially extending reinforcing iron members or may be provided with special grips, as it is described in the above-mentioned Utility Model.

Experience has shown that it can be useful to raise to a certain extent above the ground level the containers which usually have contact with the ground over their entire bottom surface areas. Also, it is desirable that the containers can be stacked even in the filled state.

It is, therefore, the primary object of the present invention to overcome the disadvantages of the prior art containers. Specifically, a container is to be provided in which the bottom surface is raised above the ground when the container is placed on the ground and which can be stacked even in the filled state.

SUMMARY OF THE INVENTION

In accordance with the present invention, a container of plastics material for mortar has support bars on its bottom side and is equipped on its top or filling side with two essentially symmetrically constructed plastics material covers.

The support bars on the bottom side of the container make it possible to pass underneath the container means for conveying the container, such as, ropes. Also, the tines of forklifts or the like can be placed under the container.

The covers of the container may serve a plurality of functions. For example, the covers protect the contents of the container, and they may serve as deposit areas and may be utilized as support surfaces for additional containers.

Support members or legs for larger containers are basically known in the art. However, the support bars according to the present invention have the particular advantage compared to prior art devices that they better serve to distribute the loads occurring in the intended field of application and that they increase the overall strength of the container.

In accordance with a further development of the invention, the container has on its bottom side integrally formed pegs which can be engaged by the support bars. These pegs make it easily possible to make the support bars of a different material than the material of the container. For example, a plastics material container can be equipped with replaceable support bars of wood, light metal or the like.

In accordance with a further development of the invention, the support bars extend parallel to one another and are spaced apart from each other, so that the designs of forklifts can be inserted as already briefly described above.

Basically, the known containers with conventional support legs or members can be moved by forklifts. However, these support legs do not provide a guidance for the tines of the forklift, so that the driver of the forklift is required to insert the tines into the space underneath the container in a very precise manner. In addition, the conventional plastics material support legs pose the danger that these legs are sheared off by the tines of the forklift. This may make the container completely unusable. All the above disadvantages are avoided by the present invention.

The support bars can be connected to the container in several different ways. The opening of the support bar for receiving the peg has in its bottom region a recess so as to define a shoulder. This shoulder is engaged by an outwardly bent end portion of the peg or by a spring ring releasably mounted on the end of the peg or by a friction welded plug or a screw-in plug having a plate-shaped end portion.

In the embodiment described above utilizing spring rings, the spring rings can be removed from the pegs together with the support bars. Subsequently, the support bars can be replaced and the spring rings can again be slid onto the pegs in order to secure the support bars.

In accordance with another embodiment of the present invention in which the covers are formed as plastics material elements which can be stacked one into the other, the manipulation of the container having a large volume can be improved if each plastics material cover has an essentially U-shaped edge portion for placement onto the horizontal outer rim of the container. A cover constructed in this manner makes it possible to more easily secure the cover on the container and the covers which can be stacked one into the other are not only simple to manufacture but also improve the storage because they require very little space. This is particularly true for the transport of empty containers, in which case several containers can be placed one into the other without covers and the covers of all containers can then be stored in the interior of the uppermost container.

In accordance with yet another embodiment of the present invention, two covers are provided for the container, wherein, in the closed position of the container, one of the covers has an upwardly projecting flange and the other cover has a bent portion which engages over this flange. The bent portion engaging over the flange may be located in the dividing plane between the two covers. In a modification of this embodiment, the invention also provides that the two covers are constructed symmetrical so as to be exchangeable, i.e., the bent portion of one of the covers extends over half the length of the cover along the dividing plane between the covers, while the bent portion of the other cover extends over the remaining half of the length of the dividing plane.

For handling of thc container by means of gripping tools, the invention further provides that the upper outer rims of the container are reinforced.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
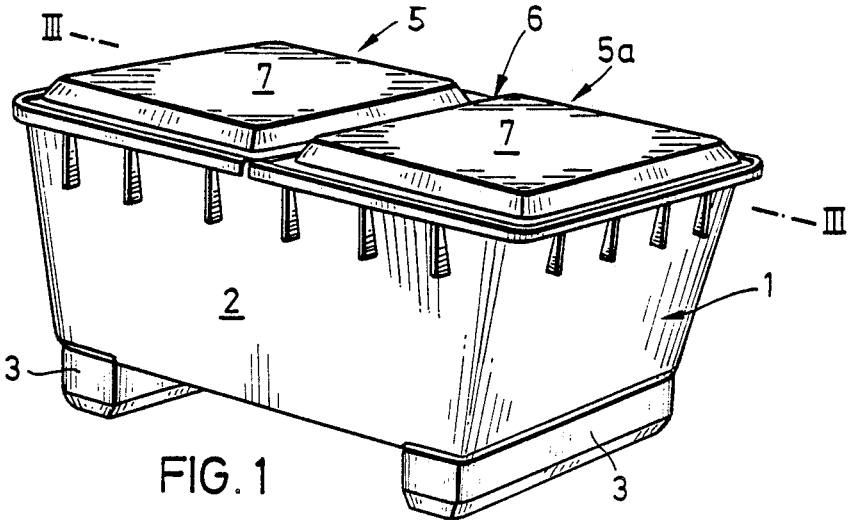
FIG. 1 is a perspective view of a container according to the present invention with covers.
Figure 2:
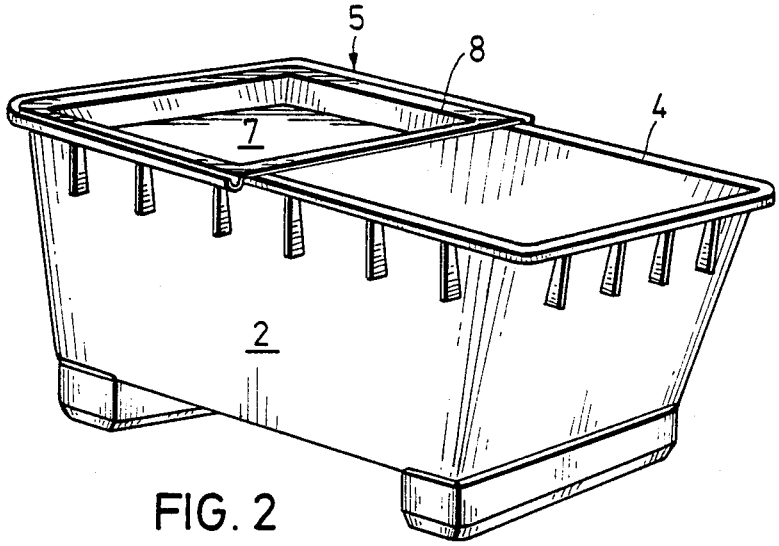
FIG. 2 is a perspective view of a container with one cover on one side of the container, with the cover being placed on the container turned over as compared to the illustration in FIG. 1.

A container for mortar generally denoted by reference numeral 1 illustrated in FIG. 1 includes a trough-like container portion 2. On the bottom side of container portion 2 are attached two support bars 3, so that, for example, the tines of a forklift can be inserted underneath the container. On the upper rim of the container portion 2 denoted by reference numeral 4 in FIG. 2 are placed two plastics material covers 5 and 5*a* which essentially have the same size, thereby forming a middle separating line 6. The covers 5 and 5*a* have a central portion 7 which, in the closing position illustrated in FIG. 1, is raised upwardly, while in the position illustrated in FIG. 2 faces downwardly in a trough-like manner.

In addition to the trough-like shape of the covers, the covers have an essentially U-shaped rim portion 8 which is used for placing the cover on the upper circumferential rim 4 of the container, so that the covers 5, 5*a* can be placed one into the other, for example, to facilitate the transport of the containers. On the other hand, only one cover can be provided as illustrated in FIG. 2. In this case, part of the container for mortar is accessible. Thus, the mortar contained in the container can be removed, for example, by means of a shovel and can be dumped into the central portion 7 of the cover 5.

Figure 3:
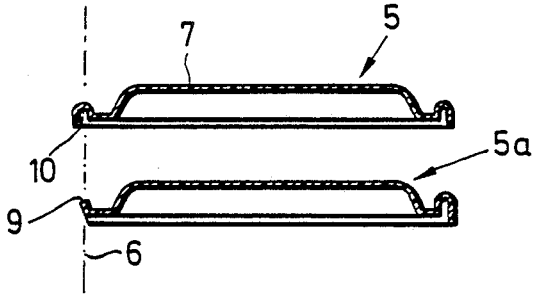
FIG. 3 are two sectional views of different embodiments of the cover essentially taken along sectional line III—III of FIG. 1.

As illustrated in FIG. 3, a cover 5*a* can be provided with an upwardly directed flange 9 extending in the dividing plane between the two covers of the container. In the closed position of the container, the flange 9 of cover 5*a* is engaged by a bent portion 10 of cover 5. Flange 9 and bent portion 10 can also be provided on each cover so as to extend over half the length of each cover along dividing plane 6, so that the two covers can be interlocked in the closed position of the container.

Figure 4:
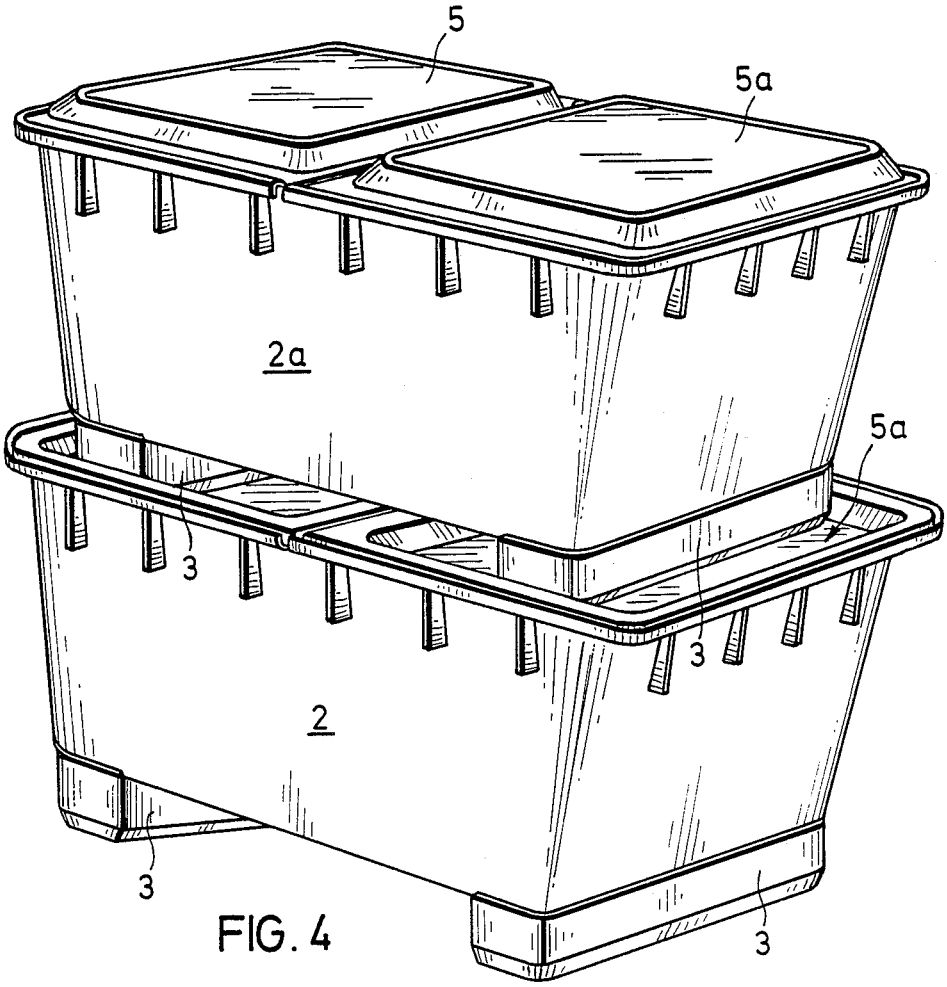
FIG. 4 is a perspective view of two containers stacked one on top of the other.

FIG. 4 is an illustration of two containers 2 and 2*a* stacked one on top of the other. The covers 5 and 5*a* of the containers are of such a shape and strength that it is possible to stack the two containers on top of each other even if the container on the top is filled. However, the cover is to be made with such a strength that it is possible to stack at least three filled containers one on top of the other.

Moreover, the shape of the support bars 3 makes possible a space-saving placement of the containers at the construction site. Also, the support bars 3 and the covers 5 are of such a shape that the tines of a forklift can at any time be inserted underneath the trough-like container portion 2, as illustrated in FIG. 4.

The embodiment of the invention described above can, of course, be changed in many respects without leaving the basic concept of the invention. For example, instead of two covers, it is also possible to provide three covers on the container. One of the covers can also be attached to the container by means of a hinge or a similar connection so as to be permanently connected to the container but pivotable with respect thereto.

Figure 5:
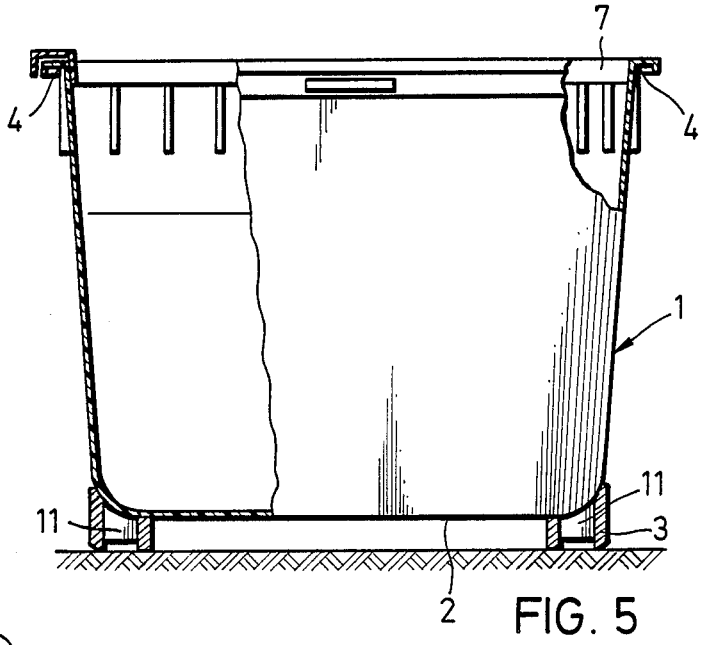
FIG. 5 is an elevational side view of the container according to the invention, partly in section.

The container 1 according to the invention can at its rim 4 be equipped with a border reinforcement, as schematically illustrated in FIG. 5. As also illustrated in FIG. 5, the bottom side of the container portion 2 is provided with pegs 11 to which the support bars 3 are connected. The different manners of connecting the support bars 3 to pegs 11 are illustrated in FIGS. 6 through 8.

Figure 6:
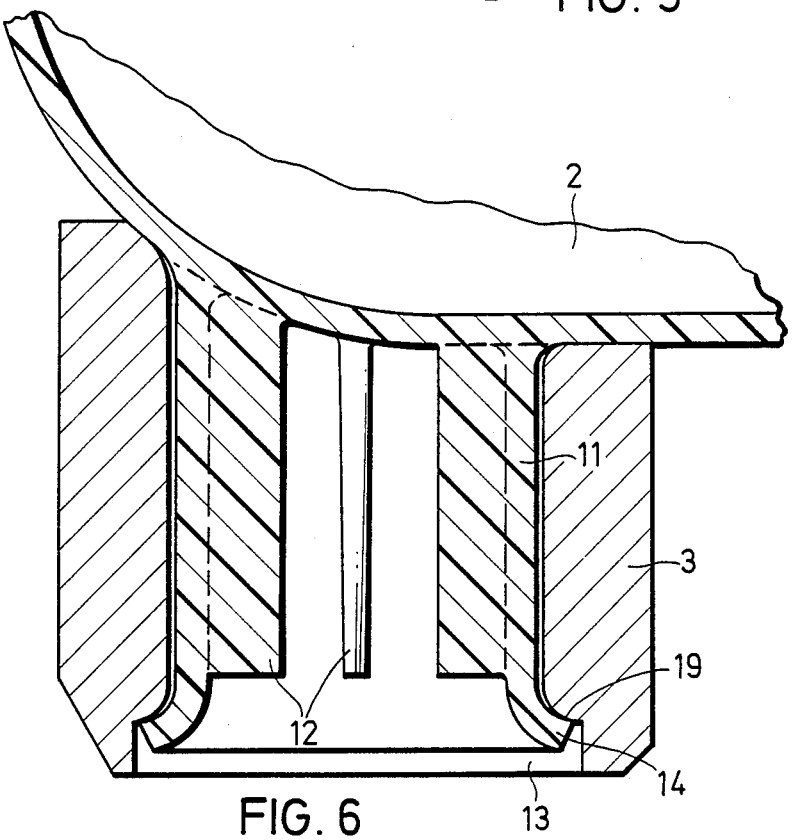
FIGS. 6–8 are, on a larger scale, showing different embodiments of the fastening of the support bars to the containers.

In the example illustrated in FIG. 6, the peg 11 provided on the bottom side of container portion 2 is a cylindrical hollow body connected integrally with container 1. The bottom end of each peg 11 is provided with an outwardly bent portion to form a clamping bead 14.

The clamping bead 14 of peg 11 engages behind a corresponding shoulder 19 which is formed in a bore 13 of the support bar 3. Thus, the support bar 3 is permanently connected to peg 11 after the bead 14 has engaged shoulder 19. The inner bore of each peg 11 may be reinforced by reinforcement ribs 12. If the connection between support bar 3 and peg 11 is to be made releasable, it is possible to provide a slit in the wall of peg 11, so that the bead 14 becomes resilient.

Figure 7:
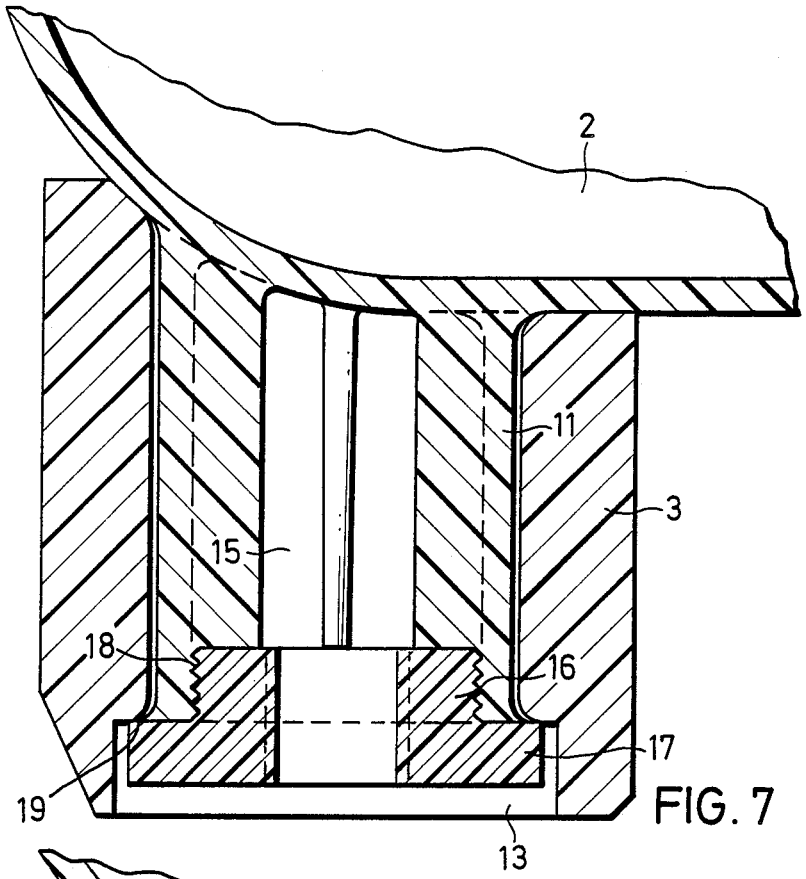
Figure 8:
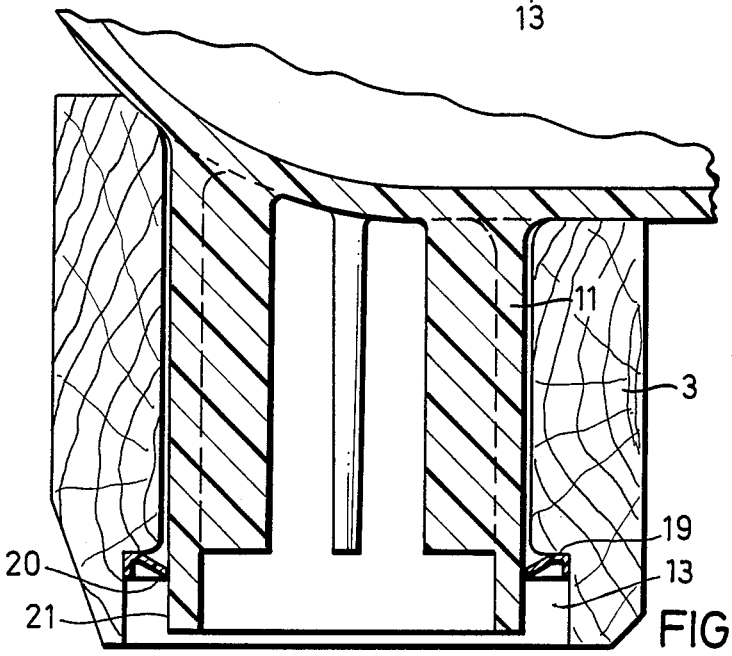

The embodiment illustrated in FIG. 7 is essentially similar to the one illustrated in FIG. 6, as far as support bar 3 and peg 11 are concerned. However, the inner bore 15 of peg 11 has formed at its outer free end a thread 18 which is engaged by a threaded plug 16. Threaded plug 16 has a plate-shaped end portion 17 which engages behind shoulder 19 of bore 13 of support bar 3.

Finally, FIG. 8 shows yet another example of fastening support bar 3 to peg 11. Peg 11 is constructed similar to the embodiments described above. However, in the region of shoulder 19 of bore 13 of support bar 3, a spring ring 20 is provided which engages the material of the outer rim portion 21 of peg 11.

The various shadings in FIGS. 6–8 are intended to show that the support bars 3 may be made of different materials, such as, light metals, plastics material, wood or a similar suitable material.

Figure 9:
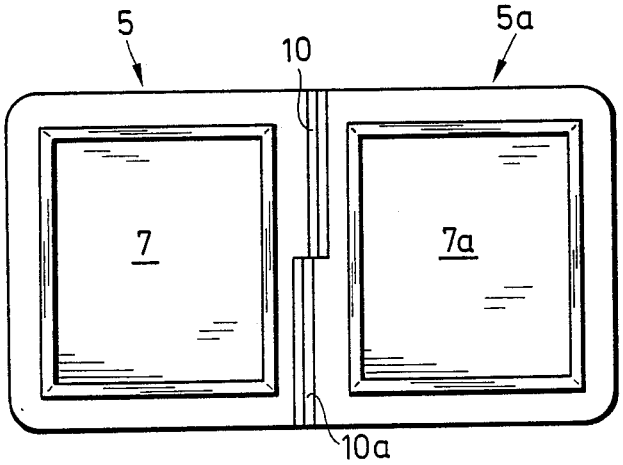
FIG. 9 is a top view of a closed container having symmetrically constructed covers.

Finally, FIG. 9 is an illustration of two covers 5 and 5*a* which are constructed symmetrically so as to be exchangeable. Thus, cover 5 has a bent portion 10 which extends only over half the length of the dividing plane between the covers and engages over a flange of the other cover 5*a* which is not visible in FIG. 9. Cover 7*a*, in turn, has a bent portion 10*a* which engages over a flange on cover 5 which is not visible in FIG. 9.

While the specific embodiments of the invention have been shown and described in detail to illustrate the application of the inventive principles, it will be understood that the invention may be embodied otherwise without departing from such principles.

I claim:

1. A container of plastics material for mortar, comprising a container portion defining a bottom side and a top side having a circumferentially extending rim, at least two essentially symmetrically constructed plastics material covers placed on the top side of the container, integrally formed pegs on the bottom side of the container, and support bars attached to the bottom side by engaging the pegs, wherein the support bars define bores open toward the bottom side of the container, the bores having formed therein a recess defining a shoulder, the pegs comprising fixing means for fixing the pegs in the bores by engaging the shoulder, and wherein the fixing means is a clamping bead formed on the outer rim of the peg.

2. A container according to claim 1, wherein the container portion is of such a size that it can be carried by one person in the filled state either not at all or with great difficulty.

3. A container according to claim 1 wherein the support bars extending parallel to one another and are spaced apart from one another to form a free space therebetween for enabling tines of forklifts to be inserted.

4. A container according to claim 1 wherein each plastics material cover has an essentially U-shaped rim portion for placement on the rim of the container.

5. A container according to claim 1 wherein the covers are stackable.

6. A container according to claim 5 wherein each cover includes a trough-shaped central portion for receiving the support bars of another container stacked on top of the container.

7. A container according to claim 1 wherein one of the covers has an upwardly directed flange in the dividing plane between the two covers and the other cover has a bent portion engaging the flange.

8. A container according to claim 7, wherein the flange of one cover extends along half the length of the cover along the dividing plane between the covers, and the other cover has an upwardly directed flange over the other half of the length of the covers along the dividing plane between the covers, wherein the flanges of each cover are engaged by bent portions formed on the facing sides of the cover.

9. A container according to claim 1, wherein the rim of the container portion is reinforced.

10. A container of plastics material for mortar, comprising a container portion defining a bottom side and a top side having a circumferentially extending rim, at least two essentially symmetrically constructed plastics material covers placed on the top side of the container, integrally formed pegs on the bottom side of the container, and support bars attached to the bottom side by engaging the pegs, wherein the support bars define bores open toward the bottom side of the container, the bores having formed therein a recess defining a shoulder, the pegs comprising fixing means for fixing the pegs in the bores by engaging the shoulder, and wherein the fixing means is a spring ring releasably attached to the peg.

11. A container of plastics material for mortar, comprising a container portion defining a bottom side and a top side having a circumferentially extending rim, at least two essentially symmetrically constructed plastics material covers placed on the top side of the container, integrally formed pegs on the bottom side of the container, and support bars attached to the bottom side by engaging the pegs, wherein the support bars define bores open toward the bottom side of the container, the bores having formed therein a recess defining a shoulder, the pegs comprising fixing means for fixing the pegs in the bores by engaging the shoulder, and wherein the fixing means is a threaded plug friction welded or screwed into a bore of the plug, the plug having a plate-shaped end portion.

* * * * *